US006076919A

United States Patent [19]

Shirota et al.

[11] Patent Number: 6,076,919

[45] **Date of Patent: *Jun. 20, 2000**

[54] JET RECORDING METHOD

[75] Inventors: Katsuhiro Shirota, Inagi; Masanori Takenouchi, Yokohama; Akira Asai, Atsugi; Hisao Yaegashi, Kawasaki; Norio Ohkuma, Yokohama; Yoshihisa Takizawa, Kawasaki; Toshiharu Inui, Yokohama; Kazuhiro Nakajima, Yokohama; Masashi Miyagawa, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/425,769

[22] Filed: Apr. 20, 1995

Related U.S. Application Data

[63] Continuation of application No. 07/928,126, Aug. 11, 1992, abandoned.

[30] Foreign Application Priority Data

| | | | |
|---|---|---|---|
| Aug. 12, 1991 | [JP] | Japan | 3-225356 |
| Aug. 12, 1991 | [JP] | Japan | 3-225358 |
| Oct. 28, 1991 | [JP] | Japan | 3-281603 |
| Oct. 28, 1991 | [JP] | Japan | 3-281614 |

[51] Int. Cl.[7] ..... B41J 2/05

[52] U.S. Cl. ..... 347/60

[58] Field of Search ..... 347/60, 61, 56, 347/12, 13

[56] References Cited

U.S. PATENT DOCUMENTS

| | | | |
|---|---|---|---|
| 4,330,787 | 5/1982 | Sato et al. | 347/100 |
| 4,410,899 | 10/1983 | Haruta et al. | 347/56 |
| 4,463,359 | 7/1984 | Ayata et al. | 347/56 |
| 4,520,373 | 5/1985 | Ayata et al. | 347/13 |
| 4,712,172 | 12/1987 | Kiyohara et al. | 346/1.1 |
| 4,723,129 | 2/1988 | Endo et al. | 347/56 |
| 4,982,199 | 1/1991 | Dunn | 347/60 |
| 5,006,864 | 4/1991 | Ayata et al. | 346/33 R |
| 5,107,276 | 4/1992 | Kneezel et al. | 346/1.1 |
| 5,109,234 | 4/1992 | Otis, Jr. et al. | 346/1.1 |
| 5,122,187 | 6/1992 | Schwarz et al. | 347/99 |
| 5,124,718 | 6/1992 | Koike et al. | 347/63 |
| 5,218,376 | 6/1993 | Asai | 346/1.1 |
| 5,305,024 | 4/1994 | Moriguchi et al. | 347/11 |
| 5,486,848 | 1/1996 | Ayata et al. | 347/15 |
| 5,861,895 | 1/1999 | Tajika et al. | 347/14 |

FOREIGN PATENT DOCUMENTS

| | | |
|---|---|---|
| 54-161935 | 12/1979 | Japan . |
| 61-185455 | 8/1986 | Japan . |
| 61-197246 | 9/1986 | Japan . |
| 61-249768 | 11/1986 | Japan . |
| 2-74351 | 3/1990 | Japan . |

*Primary Examiner*—N. Le
*Assistant Examiner*—Michael Nghiem
*Attorney, Agent, or Firm*—Fitzpatrick, Cella, Harper & Scinto

[57] ABSTRACT

In a jet recording method, a recording material is placed in a path defined by a nozzle leading to an ejection outlet, and then heated by actuating a heater disposed within the nozzle to generate a bubble within the recording material, thus ejecting a droplet of the recording material out of the ejection outlet under the action of the bubble to be attached onto recording paper. As improvement, the recording material is pre-heated by actuating the heater before the heating for generating the bubble, and the generated bubble is caused to communicate with ambience. As a result, the ejection of the recording material droplet is stabilized without causing splash or mist.

27 Claims, 14 Drawing Sheets

JET RECORDING METHOD

This application is a continuation of application Ser. No. 07/928,126 filed Aug. 11, 1992, now abandoned.

FIELD OF THE INVENTION AND RELATED ART

The present invention relates-to a jet recording method wherein a droplet of a recording material is discharged or ejected to a recording medium.

In the jet recording method, droplets of a recording material (ink) are ejected to be attached to a recording medium such as paper for accomplishing recording. In the method disclosed in U.S. Pat. Nos. 4,410,899, and 4,723,129 assigned to the present assignee among the known jet recording methods, a bubble is generated in an ink by applying a heat energy to the ink, and an ink droplet is ejected through an ejection outlet (orifice), whereby a recording head provided with high-density multi-orifices can be easily realized to record a high-quality image having a high resolution at a high speed.

In addition to the above, known jet recording methods may include the following.

Japanese Laid-Open Patent Application (JP-A) 161935/1979 discloses a recording method as illustrated in accompanying FIG. 17, wherein a liquid ink 31 in a chamber is gasified by operation of a heater 30 energized through electrodes 35, and the resultant gas 32 is ejected together with an ink droplet 33 through an ejection outlet. It is said that the plugging of an orifice can be prevented due to ejection of the gas 32 through a nozzle.

JP-A 185455/1986 discloses a recording method as illustrated in accompanying FIGS. 19A–19C, wherein a liquid ink 44 filling a minute gap 43 between a plate member 41 having a pore 40 and a heat-generating head 42 is heated by the head 42 (FIGS. 18A and 18B), and an ink droplet 46 is ejected by the created bubble 45 through the pore 40 together with the gas constituting the bubble (FIG. 18C) to form an image on recording paper.

JP-A 249768/1986 discloses a recording method as illustrated in accompanying FIGS. 19A and 19B, wherein a liquid ink 50 is supplied with a heat energy by a heating member 51 to form a bubble, and an ink droplet 58 is ejected by expansion force of the bubble together with the gas constituting the bubble through a large aperture to the ambience.

JP-A 197246/1986 discloses a recording method as illustrated in accompanying FIG. 20, wherein ink 62 filling a plurality of bores 61 formed in a film 60 is heated by a recording head 64 having a heating element 63 to generate a bubble 67 in the ink 62, thus ejecting an ink droplet 65 onto a recording medium 66 (at (a)–(f) in order in FIG. 20).

Our research group has proposed a new jet recording method (hereinafter referred to as "bubble-through recording method"), wherein a recording material is supplied with a thermal, energy corresponding to a recording signal to generate a bubble in the recording material so that a droplet of the recording material is discharged out of an ejection outlet under the action of the bubble, wherein the bubble is caused to communicate with the ambience. According to the bubble-through recording method, the splashing or misting of the recording material is prevented. Further, according to bubble-through recording method, all the recording material between the created bubble and the ejection outlet is ejected, so that the discharged amount of the recording material droplet becomes constant depending on the shape of a nozzle and the position of a heater therein, whereby a stable recording becomes possible.

SUMMARY OF THE INVENTION

An object of the present invention is to provide an improvement in the bubble-through recording method.

More specifically, an object of the present invention is to provide a jet recording method which ensures the advantages of the bubble-through recording method and further allows a high-speed stable recording with a constant discharge amount.

According to the present invention, there is provided a jet recording method, comprising: placing a recording material in a path defined by a nozzle leading to an ejection outlet, and heating the recording material by actuating a heater disposed within the nozzle to generate a bubble within the recording material, thus ejecting a droplet of the recording material out of the ejection outlet under the action of the bubble;

wherein said recording material is pre-heated by actuating the heater before the heating for generating the bubble, and the generated bubble is caused to communicate with ambience.

These and other objects, features and advantages of the present invention will become more apparent upon a consideration of the following description of the preferred embodiments of the present invention taken in conjunction with the accompanying drawings.

DETAILED DESCRIPTION OF THE INVENTION

As described above, the present invention relates to an improvement in the bubble-through recording method proposed by our research group and is characterized in that the recording material is pre-heated before the recording material is heated for generation of a bubble within the recording material.

Hereinbelow, the bubble-through recording material will be described first of all with reference to the drawings.

As in the conventional jet recording method, when a recording material is imparted with heat energy corresponding to a recording signal, a bubble is generated in the recording material and the generated bubble creates an ejection energy for ejecting the recording material through an ejection outlet.

Figure 1:
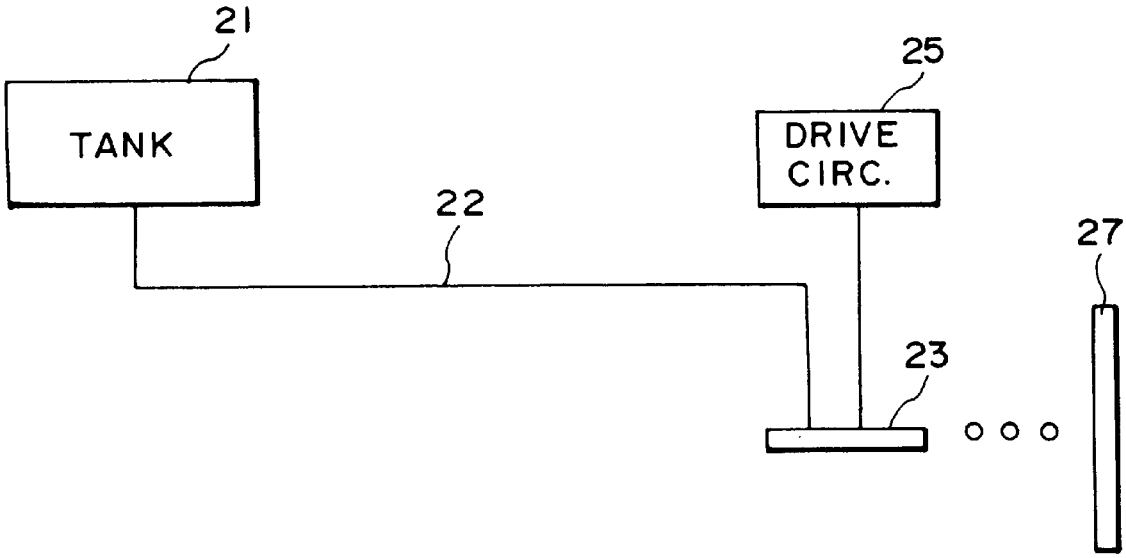
FIG. 1 is a schematic illustration of an embodiment of a recording apparatus for use in a recording method according to the invention.

FIG. 1 illustrates an apparatus for practicing the recording method according to the present invention, wherein a recording material contained in a tank 21 is supplied through a passage 22 to a recording head 23. The recording head 23 may for example be one illustrated in FIGS. 2A and 2B. The recording head 23 is supplied with a recording signal from a drive circuit 25 to drive an ejection energy-generating means (e.g., a heater) in the recording head corresponding to the recording signal, thus ejecting droplets of the recording material for recording on a recording medium 27, such as paper.

Figure 2A:
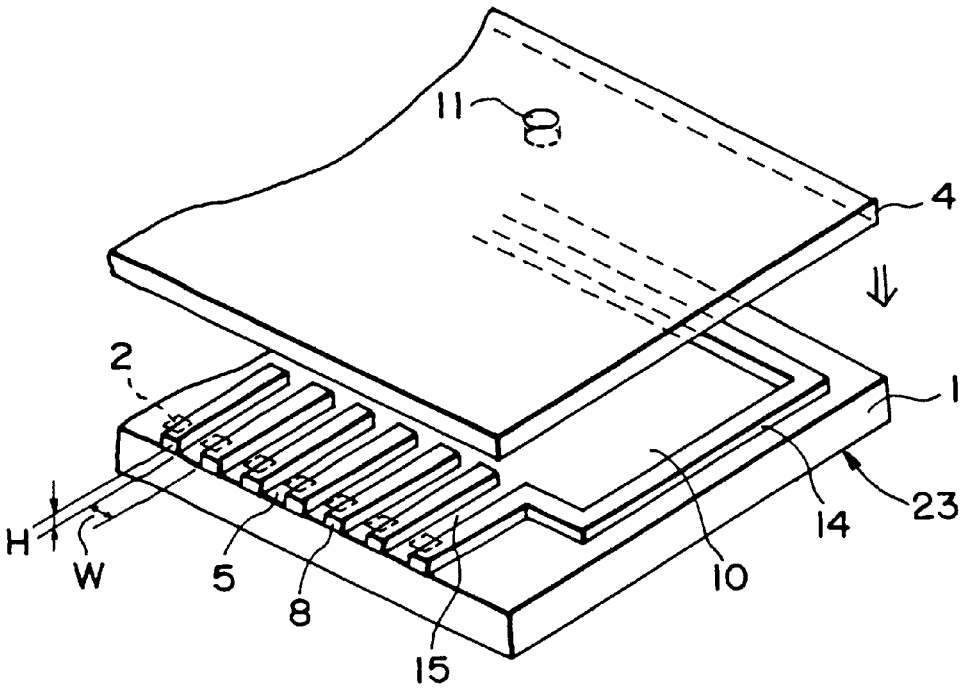
FIGS. 2A and 2B are a schematic partial perspective view and a schematic plan view of a recording head used in the recording apparatus shown in FIG. 1.
Figure 2B:
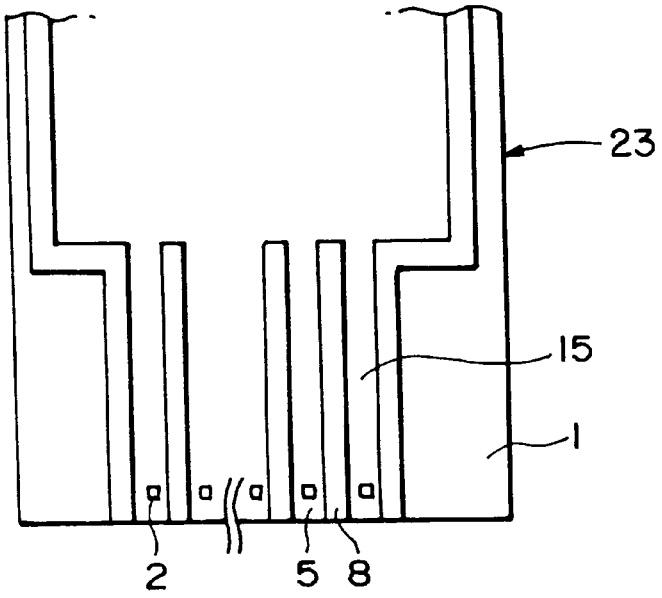

As shown in FIGS. 2A and 2B, the head 23 is provided with a plurality of walls 8 disposed in parallel with each other on a substrate 1 and a wall 14 defining a liquid chamber 10. On the walls 8 and 14, a ceiling plate 4 is disposed. In FIG. 2A, the ceiling plate 4 is shown apart from the walls 8 and 14 for convenience of showing an inside structure of the recording head. The ceiling plate 4 is equipped with an ink supply port 11, through which a recording material is supplied into the liquid chamber 10. Between each pair of adjacent walls 8, a nozzle 15 is formed for passing the recording material. At an intermediate part of each nozzle 15 on the substrate 1, a heater 2 is disposed for supplying a thermal energy corresponding to a recording signal to the recording material. A bubble is created in the recording material by the thermal energy from the heater 2 to eject the recording material through the ejection outlet 5 of the nozzle 15.

Figure 3:
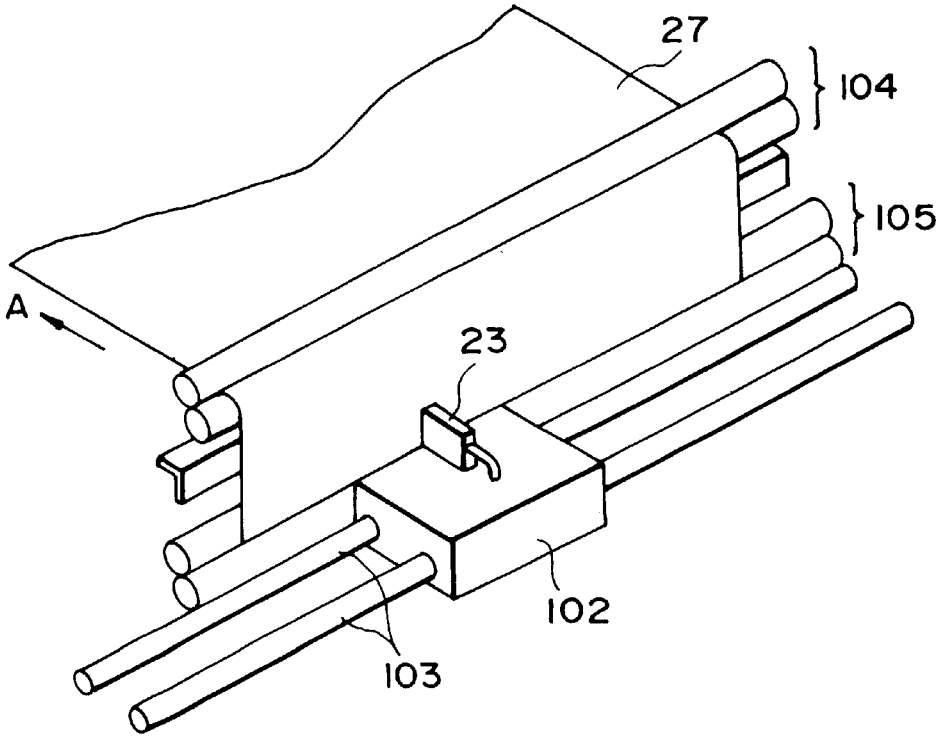
FIG. 3 is a perspective illustration of an embodiment of a recording apparatus for use in a recording method according to the invention.

As shown in FIG. 3, the recording head 23 is generally carried on a carriage 102 for recording on a recording medium 27. The carriage 102 is caused to move along a pair of guide rails 103 extending parallel to each other. Accompanying the movement, droplets of the recording material are ejected out of the recording head 23 at prescribed timing to effect recording. The recording medium 27 is moved in the direction of an arrow A by conveying rollers 104 and 105, whereby recording is successively performed.

In the bubble-through recording method, when a bubble is created and expanded by the supply of thermal energy to reach a prescribed volume, the bubble thrusts out of the ejection outlet 5 to communicate with the ambience (atmosphere). This point is explained further hereinbelow.

Figure 4A:
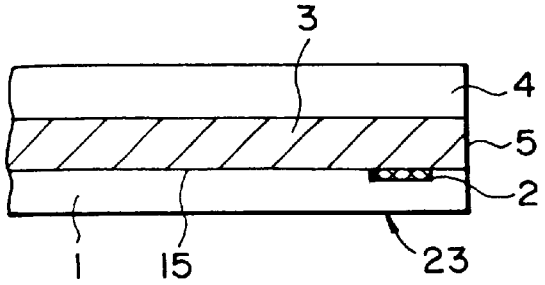
FIGS. 4A–4D are schematic sectional views of a recording head supplying a recording material for illustration of a principle of the recording method according to the invention.
Figure 4B:
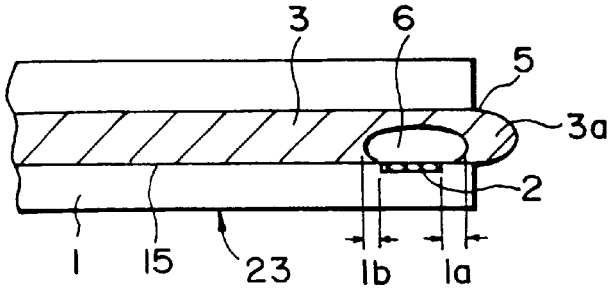
Figure 4C:
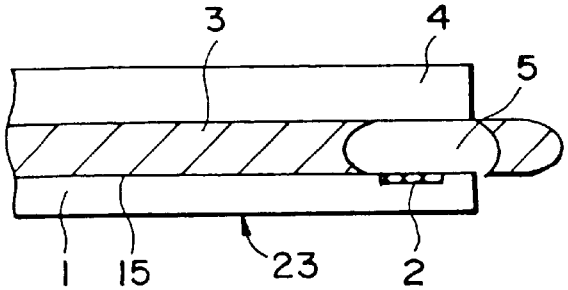
Figure 4D:
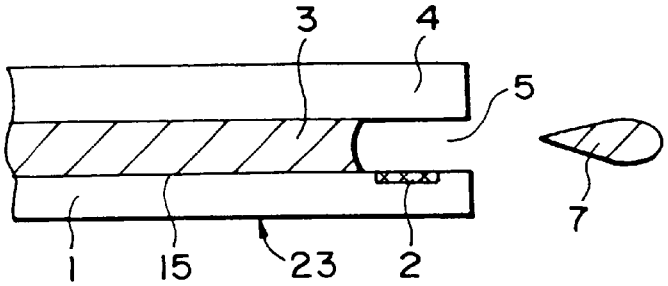

FIGS. 4A–4D show sections of a nozzle 15 formed in the recording head 23, including FIG. 4A showing a state before bubble creation. The heater 2 is supplied with a pulse current to instantaneously heat the recording material 3 in the vicinity of the heater 2, whereby the recording material 3 causes abrupt boiling to vigorously generate a bubble 6, which further begins to expand (FIG. 4B). The bubble further continually expands and grows particularly toward the ejection outlet 5 providing a smaller inertance until it thrusts out of the ejection outlet 5 to communicate with the ambience (FIG. 4C). A portion of the recording material 3 which has been closer to the ambience than the bubble 6 is ejected forward due to kinetic momentum which has been imparted thereto by the bubble 6 up to the moment and soon forms a droplet to be deposited onto a recording medium, such as paper (not shown) (FIG. 4D). A cavity left at the tip of the nozzle 15 after the ejection of the recording material 3 is filled with a fresh portion of the recording material owing to the surface tension of the succeeding portion of the recording material and the wetting of the nozzle wall to restore the state before the ejection.

In the recording head 23, the heater 2 is disposed closer to the ejection outlet 5 than in the conventional recording head. This is the simplest structure adoptable for communication of a bubble with the ambience. The communication of a bubble with the ambience is further accomplished by desirably selecting factors, such as the thermal energy generated by the heater 2, the ink properties and various sizes of the recording head (distance between the ejection outlet and the heater 2, the widths and heights of the outlet 5 and the nozzle 15). The required closeness of the heater 2 to the ejection outlet 5 cannot be simply determined but, as a measure, the distance from the front end of the heater 2 to the ejection outlet (or from the surface of the heater 2 to the ejection outlet 5 in the cases of a recording head as shown in FIGS. 8A–8D) may preferably be 5–80 microns, further preferably 10–60 microns.

In order to ensure the communication of a bubble with the ambience, the nozzle 15 may preferably have a height H which is equal to or smaller than a width W thereof, respectively at the part provided with the heater 2 (FIG. 2A). In order to ensure the bubble communication with the ambience, the heater 2 may preferably have a height H which is 50–95%, particularly 70–90%, of the width W of the nozzle. Further, it is preferred that the recording material has a viscosity of at most 100 cps.

It is further preferred to design so that a bubble communicates with the ambience when the bubble reaches 70% or more, further preferably 80% or more, of a maximum volume which would be reached when the bubble does not communicate with the ambience.

Because the bubble created in the recording material communicates with the ambience in the bubble-through recording method, substantially all the portion of the recording material present between the bubble and the ejection outlet is ejected, so that the volume of an ejected droplet becomes always constant. In the conventional jet recording method, a bubble created in the recording material does not ordinarily communicate with the ambience-but shrinks to disappear after reaching its maximum volume. In the conventional case where a bubble created in the recording material does not communicate with the ambience, not all but only a part of the portion of recording material present between the bubble and the ejection outlet is ejected.

In the jet recording method wherein a bubble does not communicate with the ambience but shrinks after reaching the maximum, the bubble does not completely disappear by shrinkage but remains on the heater in some cases. If a small bubble remains on the heater, there arises a problem that bubble creation and growth for ejecting a subsequent droplet are not normally accomplished due to the presence of such a small bubble remaining on the heater. In contrast thereto, in the bubble-through recording method wherein a bubble is communicated with the ambience, all the recording material present between the bubble and the ejection outlet is ejected so that such a small bubble is not allowed to remain on the heater.

In the bubble-through recording method, only a small inertance is present between the heater 2 and the ejection outlet 5 of the recording head 23, so that the kinetic momentum of a created bubble 6 is effectively imparted to a droplet 7. For this reason, even a material having a high viscosity which cannot be easily ejected according to the conventional recording method, such as a liquefied ink formed by heating a normally solid recording material to above its melting point, can be stably ejected. Further, in the bubble-through recording method, the ejection speed of the recording material becomes very fast because a bubble created in the recording material communicates with the ambience. Accordingly, a droplet of the recording material is attached accurately to an objective point on the recording medium, and even a normally solid recording material can be attached to the recording medium in a small thickness without pile-up. The attachment in a small thickness of the solid recording material on the recording medium is most advantageous in superposing several colors of recording materials on a single recording medium to form a multicolor image.

In the bubble-through recording method, it is preferred that a bubble created by the heater 2 is caused to communicate with the ambience out of the ejection outlet 5 when the internal pressure of the bubble is not higher than the ambient (atmospheric) pressure.

Figure 5:
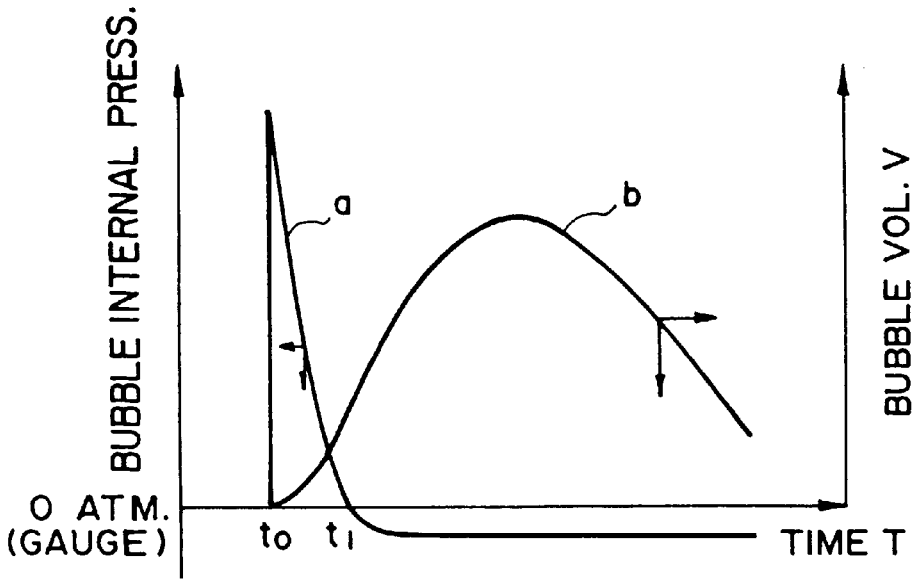
FIG. 5 PRIOR ART
FIG. 5 is a graph showing an example of changes in internal pressure and volume of a bubble in the case of non-communication of the bubble with the ambience (atmosphere).

FIG. 5 is a graph showing a relationship between the internal pressure (curve a) and the volume (curve b), of a bubble in a case where the bubble does not communicate with the ambience. Referring to FIG. 5, at time $T=t_0$ when the heater 2 is energized with a pulse current, a bubble is created in the recording material to cause an abrupt increase in bubble internal pressure and the bubble starts to expand simultaneously with the creation.

The bubble expansion does not cease immediately after the termination of current supply to the heater 2 but continues for a while thereafter. As a result, the bubble internal pressure abruptly decreases to reach a pressure below the ambient pressure (0 atm.-gauge) after $T=t_1$. After expansion to some extent, the bubble starts to shrink and disappears.

Figure 6:
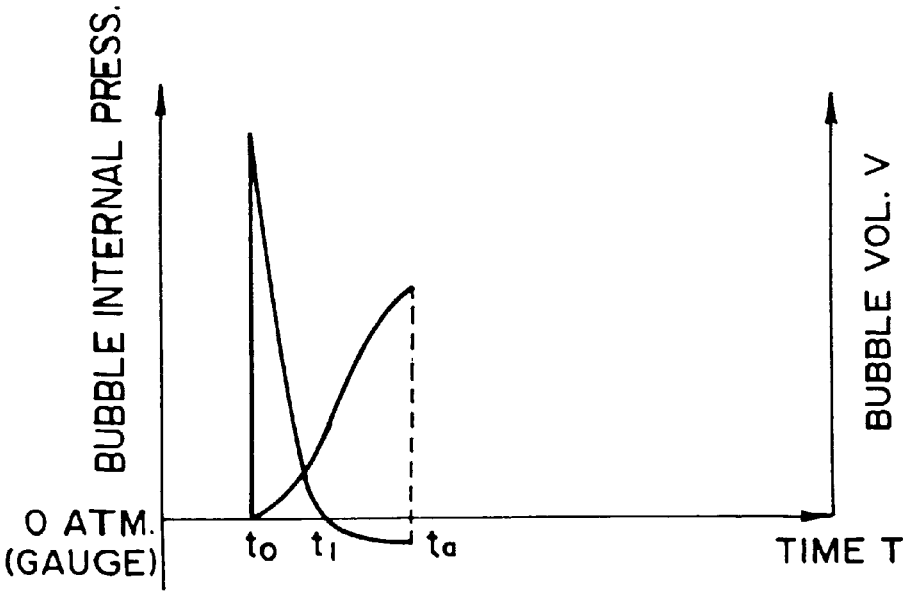
FIG. 6 is a graph showing an example of changes in internal pressure and volume of a bubble in the case of communication of the bubble with the ambience.

Accordingly, if the bubble is caused to communicate with the ambience at some time after time $T=t_1$, e.g., time ta, as shown in FIG. 6, the bubble internal pressure immediately before the communication is lower than the ambient pressure.

If the bubble is communicated with the ambience to eject a droplet when the internal pressure thereof is below the ambient pressure, the formation of splash or mist of the recording material unnecessary for recording can be prevented, so that the soiling of the recording medium or the apparatus is avoided.

Hitherto, in the conventional jet recording method, there has been encountered a problem that splash or mist of the recording material is ejected in addition to a droplet effective for recording. The occurrence of such splash or mist can be prevented by lowering the bubble internal pressure to a value not higher than the ambient pressure when the bubble is communicated with the ambience in the bubble-through recording method.

It is difficult to directly measure the bubble internal pressure, but the satisfaction of the condition of the bubble internal pressure being smaller than the ambient pressure may be suitably judged in the following manner.

Figure 7:
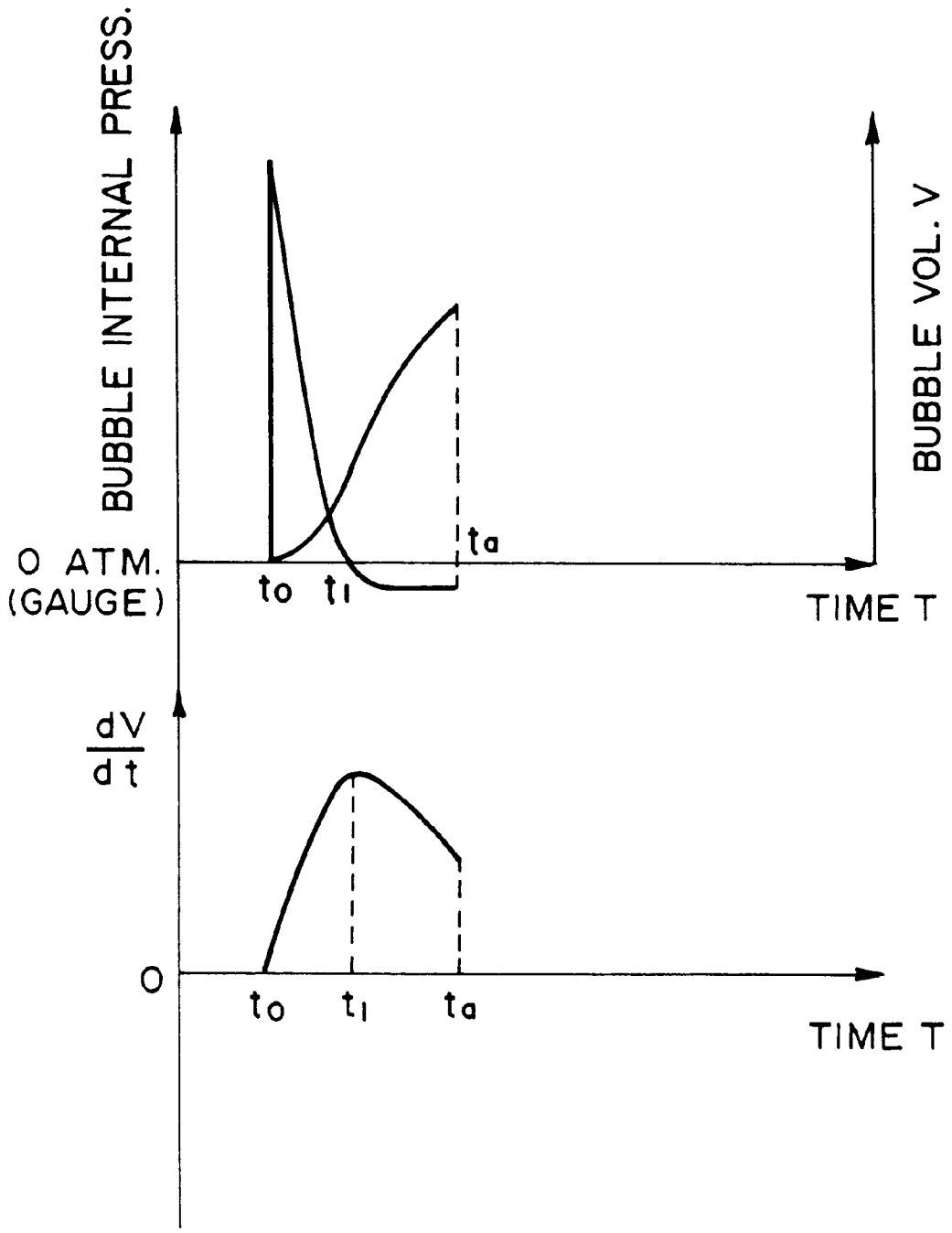
FIG. 7 is a graph showing an example of changes in internal pressure, volume and further volume-changing rate of a bubble in the case of communication of the bubble with the ambience.

The volume Vb of the bubble is measured from the start of the bubble creation to the communication thereof with the ambience. Then, the second order differential $d^2Vb/dt^2$ is calculated, based on which the relative magnitudes of the internal pressure and the atmospheric pressure may be judged. If $d^2Vb/dt^2>0$, the internal pressure is higher than the ambient pressure. If $d^2Vb/dt^2 \leqq 0$, the internal pressure is not higher than the ambient pressure. Referring to FIG. 7, during a period from the state of bubble creation at time $T=t_0$ to time $T=t_1$, the bubble internal pressure is higher than the ambient pressure ($d^2Vb/dt^2>0$), and during a period from time $T=t_1$ to the bubble communication with the ambience at time T=ta, the bubble internal pressure is lower than the ambient pressure. As described above, by calculating $d^2Vb/dt^2$, i.e., the second order differential of Vb, it is possible to know the relationship regarding magnitude between the bubble internal pressure and the ambient pressure.

Instead of measuring the above-mentioned bubble volume Vb, it is also possible to judge the relative magnitudes of the bubble internal pressure and the ambient pressure by measuring the volume Vd of a protrusion 3*a* (FIG. 4B) of the recording material out of the ejection outlet 5 (hereinafter called "ink protrusion 3*a*") in a period from the start of the bubble creation to the ejection of a droplet of the recording material (a period between the states shown in FIGS. 4A and 4C) and calculating the second order differential of Vd, i.e., $d^2Vd/dt^2$. More specifically, if $d^2Vd/dt^2>0$, the bubble internal pressure is higher than the ambient pressure, and if $d^2Vd/dt^2 \leqq 0$, the bubble internal pressure is not higher than the ambient pressure.

Further, if the bubble is communicated with the ambience when the first order differential of the moving speed of the bubble front in the ejection direction is negative, the occurrence of mist or splash can be further prevented.

Referring to FIG. 4B, if the distance $\mathbf{1}_a$ from the ejection outlet 5 side end of the heater 2 as the ejection energy generating means to the front end (ejection outlet 5 side end) of a bubble 6 and the distance $\mathbf{1}_b$ from the opposite side end of the heater 2 to the rear end (on the side opposite to the ejection outlet 5) of the bubble are set to satisfy $\mathbf{1}_a/\mathbf{1}_b \geqq 1$, preferably $\mathbf{1}_a/\mathbf{1}_b \geqq 2$, more preferably $\mathbf{1}_a/\mathbf{1}_b \geqq 4$, at an instant immediately before the communication with the ambience, it is possible to shorten the time for filling the cavity formed after ejection of the recording head with a fresh portion of the recording material, thus realizing a further high-speed recording. The ratio $\mathbf{1}_a/\mathbf{1}_b$ may be increased, e.g., by shortening the distance between the heater 2 and the ejection outlet 5.

Figure 8A:
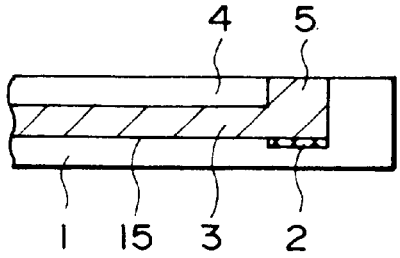
FIGS. 8A–8D are schematic sectional views of another example of a recording head supplying a recording material for illustration of a principle of the recording method according to the invention.
Figure 8B:
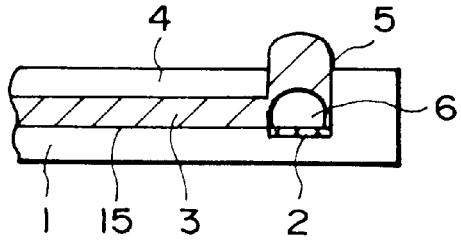
Figure 8C:
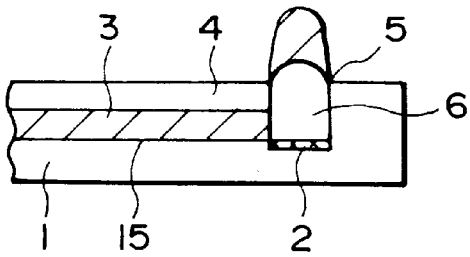
Figure 8D:
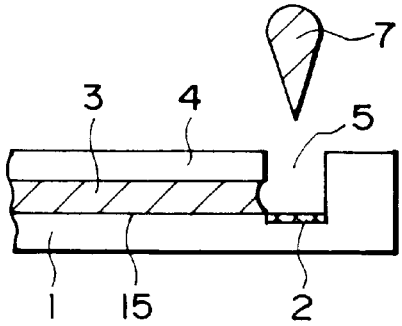

FIGS. 8A–8D illustrate another embodiment of the recording head used in the present invention which includes an ejection outlet 5 disposed on a lateral side of a nozzle 15. Also in the case of using the recording head shown in FIGS. 8A–8D, a bubble 6 is caused to communicate with the ambience similarly as in the case of using the head shown in FIGS. 3A–3D. More specifically, from a state before bubble generation in FIG. 8A, a recording material 3 melted under operation of a heating means (unshown) is heated by energizing a heater 2 to create a bubble 6 on the heater 2 (FIG. 8B). The bubble 6 continues to expand (FIG. 8C) until it communicates with the ambience to eject a droplet 7 out of the ejection outlet 5 (FIG. 8D).

According to the present invention, in the bubble-through recording method described above, the recording material is subjected to heating within an extent not causing bubble generation (hereinafter called "pre-heating" in advance of heating for generation or creation of a bubble (hereinafter simply called "bubble-generation (heating)").

Both the pre-heating and bubble-generation heating are performed by energizing the heater 2 disposed within the nozzle 15. More specifically, the pre-heating and bubble-generation heating may be performed by applying voltage pulses to the heater 2.

Figure 9A:
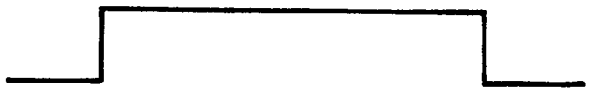
FIGS. 9A–9D illustrate pre-heating pulses applied in the recording method of the invention.
Figure 9B:
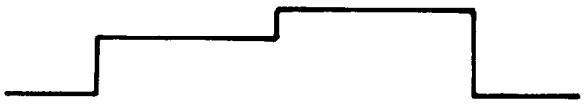
Figure 9C:
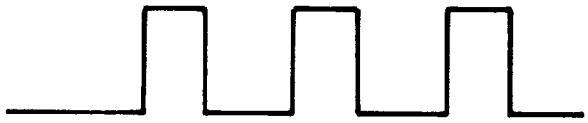
Figure 9D:
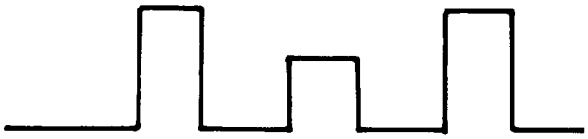

The pre-heating may be performed by applying one or more voltage pulses (pre-heating pulse(s)), e.g., as shown in FIGS. 9A–9D, wherein FIG. 9A shows a relatively long single pre-heating pulse. FIG. 9B shows a succession of two pulses having different voltage levels. In this way, the succession or continuation of two voltage levels appearing stepwise as shown in FIG. 9B are regarded herein as a succession of two voltage pulses while zero levels are not counted in the number of pulses. FIG. 3C shows a succession of plural (three) relatively short pre-heating pulses. FIG. 9D shows a succession of plural pre-heating pulses having different voltage levels.

The bubble-generation heating is generally performed by application of a single pulse (referred to as "bubble-generation pulse". It is also possible to effect the bubble-generation heating by plural pulses, but application of a pulse after bubble-generation cannot have a substantial meaning. For this reason, the bubble-generation pulse is generally composed of a single pulse which is generally placed as the last pulse in a pulse train comprising plural pulses for pre-heating and bubble-generation, and the preceding pulse(s) in the pulse train constitute the pre-heating pulse(s).

Whether a bubble is created or not in the recording material depends on the level of an energy imparted by the pulse(s).

Each pulse constituting the pre-heating pulse(s) may preferably have a width of 0.2–1.5 μsec, further preferably 0.2–1.0 μsec, particularly 0.3–0.8 μsec, and an amplitude of 4–35 volts. As described, the spacing between individual pre-heating pulses need not be present but, when present, may preferably be 0.8–7.0 μsec, further preferably 1.0–5.0 μsec.

The bubble-generation pulse may preferably have a width of 0.8–5.0 μsec, further preferably 1.0–4.0 μsec, and an amplitude of 10–35 volts.

The number of pre-heating pulses may preferably be 2–30, further preferably 3–20, particularly preferably 3–5, in the case of using a normally liquid recording material, and 10–60, further preferably 20–50, in the case of using a normally solid recording material.

The recording material used in the jet recording method according to the present invention may be either a normally liquid one, i.e. one which is liquid at room temperature (5° C.–35° C.) or a normally solid one.

The normally liquid recording material may comprise, e.g., water, an organic solvent and a colorant, and optionally an additive used as desired.

Examples of the organic solvent constituting the normally liquid recording material may include: alkyl alcohols having 1–5 carbon atoms, such as methyl alcohol, ethyl alcohol, n-propyl alcohol, isopropyl alcohol, n-butyl alcohol, sec-butyl alcohol, tert-butyl alcohol, iso-butyl alcohol, and n-pentyl alcohol; amides, such as dimethylformamide, and dimethylacetamide; ketones or ketone alcohols, such as acetone, and diacetone alcohol; ethers, such as tetrahydrofuran, and dioxane; oxyethylene or oxypropylene adduct polymers, such as diethylene glycol, triethylene glycol, tetraethylene glycol, dipropylene glycol, tripropylene glycol, polyethylene glycol, and polypropylene glycol; alkylene glycols including an alkylene group having 2–6 carbon atoms, such as ethylene glycol, propylene glycol, trimethylene glycol, butylene glycol, 1,2,6-hexanetriol, and hexylene glycol; triodiglycol; glycerin; lower alkyl ethers of polyhydric alcohols, such as ethylene glycol mono-methyl (or -ethyl) ether, diethylene glycol mono-methyl (or -ethyl) ether and triethylene glycol mono-methyl (or -ethyl) ether; lower dialkyl ethers of polyhydric alcohols, such as triethylene glycol di-methyl (or -ethyl) ether, and tetraethylene glycol di-methyl (or -ethyl) ether; sufolane, N-methyl-2-pyrrolidone, and 1,3-dimethyl-2-imidazolidinone.

Examples of the colorant constituting the normally liquid recording material may include: direct dyes, acid dyes, food dyes, basic dyes, reactive dyes, disperse dyes, vat dyes, soluble vat dyes, reactive disperse dyes, oil dyes, and various pigments.

The normally liquid recording material may preferably contain 50–99 wt. %, particularly 60–98 wt. %, of water; 1–50 wt. %, particularly 2–30 wt. %, of an organic solvent, and 0.2–20 wt. %, particularly 0.5–10 wt. %, of a colorant.

In addition to the above components, the normally liquid recording material can contain various dispersing agents, surfactants, viscosity modifiers, surface tension modifiers, and fluorescent brightening agents, optionally as desired.

In the case of using a normally solid recording material, the recording material is heated in a melted state and, while being kept in the melted state, is subjected to the pre-heating and bubble-generation heating.

Figure 10:
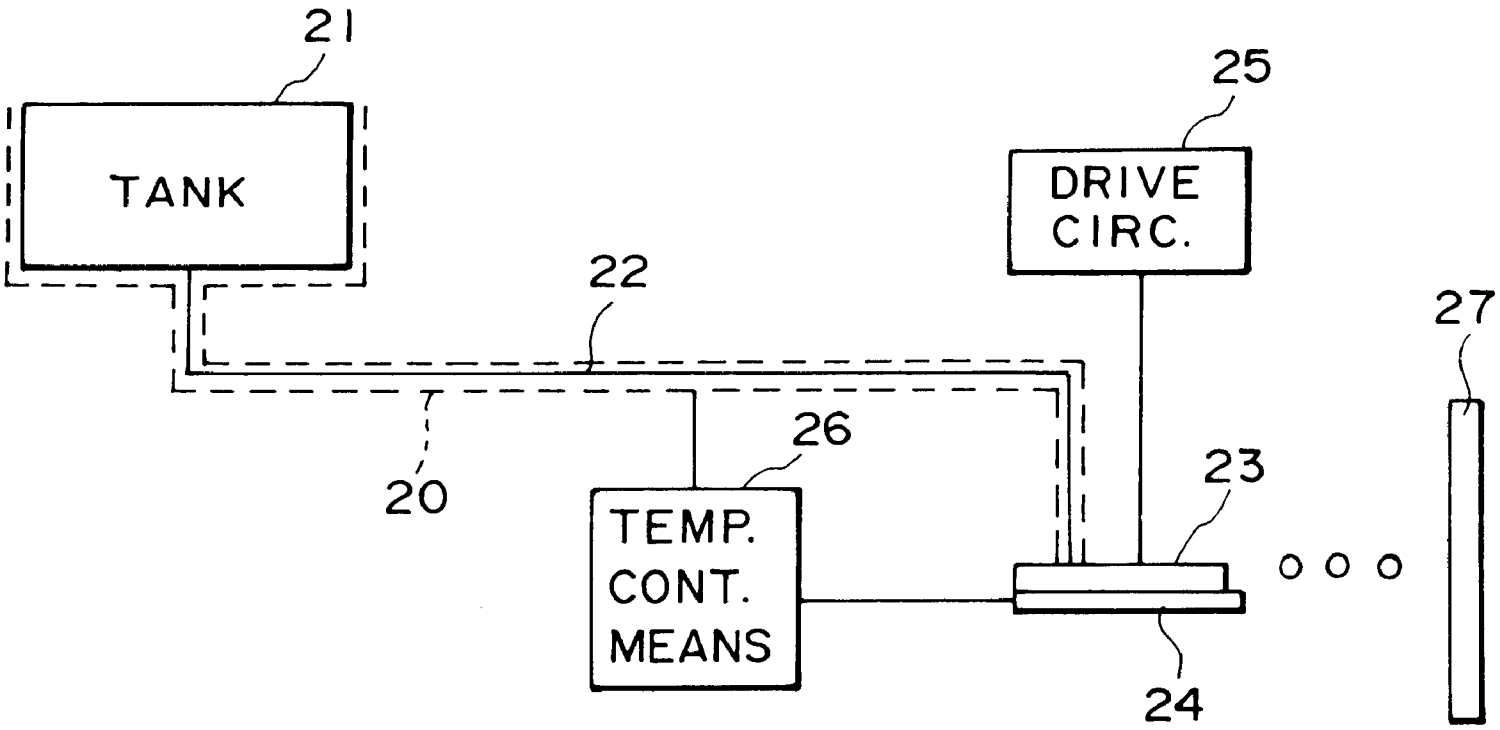
FIG. 10 is a schematic illustration of another embodiment of a recording apparatus for use in a recording method according to the invention.

In order to keep the normally solid recording material in a molten state, the recording apparatus may be provided with heating means 20 and 24 for the tank 21, passage 22 and recording head 23, as shown in FIG. 10 in comparison with FIG. 1. The heating means 20 and 24 are energized under control by a temperature control means 26 so as to keep the recording material at a prescribed temperature of preferably 10–20° C. higher than the normally solid recording material.

The normally solid recording material used in the present invention may comprise at least a heat-fusible solid substance and a colorant, and optionally additives for adjusting ink properties and a normally liquid organic solvent, such as an alcohol.

The normally solid recording material may preferably have a melting point in the range of 36° C. to 200° C. Below 36° C., the recording material is liable to be melted or softened according to a change in room temperature and may soil user's hands. Above 200° C., a large quantity of energy is required for liquefying the recording material. More preferably, the melting point is in the range of 36° C.–150° C.

The heat-fusible substance contained in the normally solid recording material may, for example, include: acetamide, p-vaniline, o-vaniline, dibenzyl, m-acetotoluidine, phenyl benzoate, 2,6-dimethylquinoline, 2,6-dimethoxyphenol, p-methylbenzyl alcohol, p-bromoacetophenone, homocatechol, 2,3-dimethoxybenzaldehyde, 2,4-dichloroaniline, dichloroxylylene, 3,4-dichloroaniline, 4-chloro-m-cresol, p-bromophenol, dimethyl oxalate, 1-naphthol, dibutylhydroxytoluene, 1,3,5-trichlorobenzene, p-tertpentylphenol, durene, dimethyl-p-phenylenediamine, tolan, styrene glycol, propionamide, diphenyl carbonate, 2-chloronaphthalene, acenaphthene, 2-bromonaphthalene, indole, 2-acetylpyrrole, dibenzofuran, p-chlorobenzyl alcohol, 2-methoxynaphthalene, tiglic acid, p-dibromobenzene, 9-heptadecanone, 1-tetradecanamine, 1,8-octanediamine, glutaric acid, 2,3-dimethylnaphthalene, imidazole, 2-methyl-8-hydroxyquinoline, 2-methylindole, 4-methylbiphenyl, 3,6-dimethyl-4-octyne-diol, 2,5-dimethyl-3-hexyne-2,5-diol, 2,5-dimethyl-2,5-hexanediol, ethylene carbonate, 1,8-octane diol, 1,1-diethylurea, butyl p-hydroxybenzoate, methyl 2-hydroxynaphthoate, 8-quinolinol, stearylamine acetate, 1,3-diphenyl-1,3-propanedione, methyl m-nitrobenzoate, dimethyl oxalate, phthalide, 2,2-diethyl-1,3-propanediol, N-tert-butylethanolamine, glycolic acid, diacetylmonooxime, and acetoxime. These heat-fusible substances may be used singly or in mixture of two or more species.

The above-mentioned heat-fusible substances include those having various characteristics, such as substances having particularly excellent dischargeability, substances having particularly excellent storability and substances providing little blotting on a recording medium. Accordingly, these heat-fusible substances can be selected depending on desired characteristics.

A heat-fusible substance having a melting point Tm and a boiling point Tb (at 1 atm. herein) satisfying the following formulae (A) and (B) may preferably be used so as to provide a normally solid recording material which is excellent in fixability of recorded images and can effectively convert a supplied thermal energy to a discharge energy.

$$36^\circ\ C. \leqq Tm \leqq 150^\circ\ C. \quad (A)$$

$$150^\circ\ C. \leqq Tb \leqq 370^\circ\ C. \quad (B)$$

The boiling point Tb may preferably satisfy $200^\circ\ C. \leqq Tb \leqq 340^\circ\ C.$ The colorant contained in the normally solid recording material may include known ones inclusive of various dyes, such as direct dyes, acid dyes, basic dyes, disperse dyes, vat dyes, sulfur dyes and oil-soluble dyes, and pigments. A particularly preferred class of dyes may include oil-soluble dyes, including those described below disclosed in the color index: C.I. Solvent Yellow 1, 2, 3, 4, 6, 7, 8, 10, 12, 13, 14, 16, 18, 19, 21, 25, 25:1, 28, 29, etc.;

C.I. Solvent Orange 1, 2, 3, 4, 4:1, 5, 6, 7, 11, 16, 17, 19, 20, 23, 25, 31, 32, 37, 37:1, etc.;

C.I. Solvent Red 1, 2, 3, 4, 7, 8, 13, 14, 17, 18, 19, 23, 24, 25, 26, 27, 29, 30, 33, 35, etc.;

C.I. Solvent Violet 2, 3, 8, 9, 10, 11, 13, 14, 21, 21:1, 24, 31, 32, 33, 34, 36, 37, 38, etc.;

C.I. Solvent Blue 2, 4, 5, 7, 10, 11, 12, 22, 25, 26, 35, 36, 37, 38, 43, 44, 45, 48, 49, etc.;

C.I. Solvent Green 1, 3, 4, 5, 7, 8, 9, 20, 26, 28, 29, 30, 32, 33, etc.;

C.I. Solvent Brown 1, 1:1, 2, 3, 4, 5, 6, 12, 19, 20, 22, 25, ,28, 29, 31, 37, 38, 42, 43, etc.; and C.I. Solvent Blank 3, 5, 6, 7, 8, 13, 22, 22:1, 23, 26, 27, 28, 29, 33, 34, 35, 39, 40, 41, etc.

It is also preferred to use inorganic pigments, such as calcium carbonate, barium sulfate, zinc oxide, lithopone, titanium oxide, chrome yellow, cadmium yellow, nickel titanium yellow, naples yellow, yellow iron oxide, red iron oxide, cadmium red, cadmium mercury sulfide, Prussian blue, and ultramarine; carbon black; and organic pigments, such as azo pigments, phthalocyanine pigments, triphenylmethane pigments and vat-type pigments.

The normally solid recording material can further contain a normally liquid organic solvent, as desired, examples of which may include alcohols, such as 1-hexanol, 1-heptanol, and 1-octanol; alkylene glycols, such as ethylene glycol, propylene glycol, and triethylene glycol; ketones, ketone alcohols, amides, and ethers. Such an organic solvent may have a function of enlarging the size of a bubble generated in the recording material and may preferably have a boiling point of at least 150° C.

The normally solid recording material can result in a relief image on a recording paper which is poor in rubbing resistance because of too large a solidifying speed depending on the heat-fusible substance used. In such a case of resulting in a relief image, it is suitable to retard the solidification of the recording material by incorporating a liquid having a low vapor pressure (of at most 3 mmHg at 25° C.) in the recording material. The lower limit of the vapor pressure of such a liquid may be on the order of 0.001 mmHg at 25° C.

Examples of such a low-vapor pressure liquid may include: y-butylolactone, 2-pyrrolidone, propylene carbonate, N-methyl-2-pyrrolidone, N-methylpropionamide, N-methylacetamide, 2-butoxyethanol, dipropylene glycol monomethyl ether, dipropylene glycol monoethyl ether, tripropylene glycol monomethyl ether, diacetone alcohol, 2-ethoxyethyl acetate, butoxyethyl acetate, diethylene glycol monoethyl ether acetate, and diethylene glycol monobutyl ether acetate.

The normally solid recording material can further contain optional additives, such as antioxidants, dispersing agents and anti-corrosion agents.

The normally solid recording material may preferably contain 50–99 wt. %, particularly 60–95 wt. %, of a heat-fusible substance; 1–20 wt. %, particularly 3–15 wt. %, of a colorant; and 0–10 wt. % of an optionally added organic solvent.

The optional low-vapor pressure liquid, when contained, may preferably constitute 30–70 wt. %, particularly 35–60 wt. %, of the recording material.

As described hereinabove, in the jet recording method according to the present invention, the recording material in the vicinity of the heater 2 is heated by application of pre-heating pulses to an elevated temperature providing a relatively low viscosity and then heated by application of a bubble-generation pulse to generate and grow a bubble 6. Because of the low viscosity of the recording material surrounding the bubble 6 due to the pre-heating, the bubble 6 receives a small resistance to its growth to acquire a large growing speed and become a relatively large bubble.

As a result, the ejection speed of the recording material droplet discharged out of the ejection outlet is increased. Further, as the bubble is promoted to grow to a larger volume, thus being easily communicated with the ambience, the discharge of the recording material present within a range between the ejection outlet-side end of the heater 2 and the ejection outlet (hereinafter called "OH range" for convenience) is improved. In this way, according to the jet recording method of the present invention, not only the discharge velocity of the recording material droplet is improved but also the discharge amount of the droplet becomes further constant.

In the jet recording method according to the invention, it is further possible to regulate the discharge amount of the recording material. More specifically, in the jet recording method of the invention, almost all of the recording material within the OH range of the nozzle is discharged but some recording material can still remain on the wall of the nozzle. The amount of the nozzle remaining on the wall is decreased when the pre-heating temperature is increased to effect substantially complete discharge, but is increased when the pre-heating temperature is lowered.

Incidentally, a record head having liquid passages disposed at a high density as shown in FIGS. 2A and 2B may be typically produced through a process wherein electrothermal transducing elements and electrodes, walls and a ceiling plate for defining liquid passages are formed on a silicon wafer, and then the wafer is cut at a prescribed position. In such a process, the cutting accuracy and the production yield are liable to be contradictory with each other. Accordingly, in order to ensure a level of production yield, some fluctuation in OH range can remain among the recording head products.

Accordingly, if the pre-heating temperature is regulated for each recording head according to the recording method of the present invention, it is possible to minimize the fluctuation in volume of discharged droplet even if the OH range fluctuates among the head products. For example, when three recording heads having OH ranges of $L_1$, $L_2$ and $L_3$ ($L_1>L_2>L_3$), respectively, are used for discharging droplets, the volume of the droplets discharged can be equalized by setting the pre-heating temperatures $T_1$, $T_2$ and $T_3$, respectively, so as to satisfy $T_1<T_2<T_3$. Further, even in case where discharge amounts through nozzles are different in a single head, it is possible to minimize the difference by controlling the pre-heating temperatures for the respective nozzles.

Further, according to the jet recording method of the present invention, it is possible to decrease the thermal energy for discharging the recording material. This is explained in more detail with reference to examples shown in FIGS. 11A–11C.

Figure 11A:
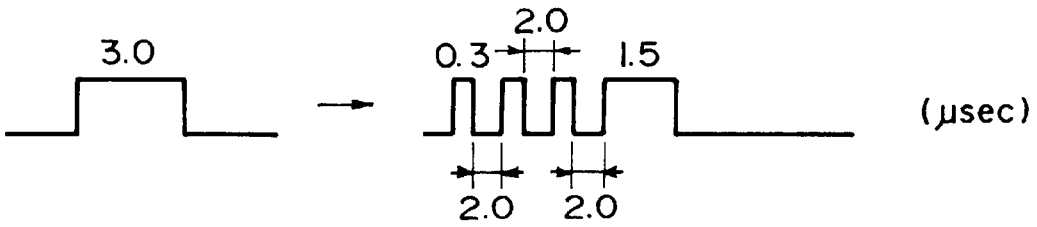
FIGS. 11A–11C respectively illustrate a comparison between a pulse applied in a conventional recording method and a combination of pre-heating pulse and a bubble-generating pulse in the recording method of the invention.

In an example shown in FIG. 11A, an ink droplet was discharged by a conventional single pulse with a width of 3.0 μsec (shown on the left side) whereas an ink droplet of the same volume could be discharged by a pulse train of the same amplitude having a pulse width total of 2.4 μsec (=0.3 μsec×3+1.5 μsec) when three pre-heating pulses of 0.3 μsec were applied in advance of a bubble-generation pulse of 1.5 μsec (as shown on the right side).

Figure 11B:
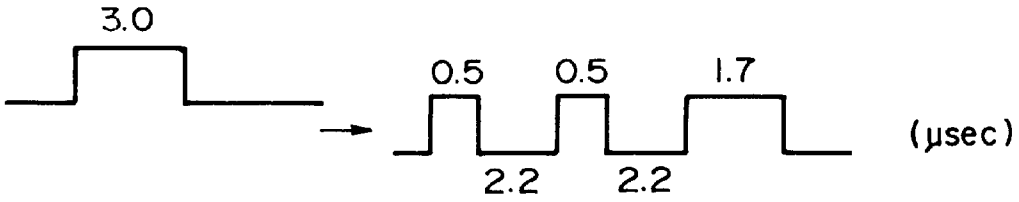

In an example of FIG. 11B, two pre-heating pulses of a larger width were used whereby a droplet of the same volume could be discharged in a total pulse width of 2.7 μsec (0.5 μsec×2+1.7 μsec) shorter than 3.0 μsec by a conventional single bubble-generation pulse.

Figure 11C:
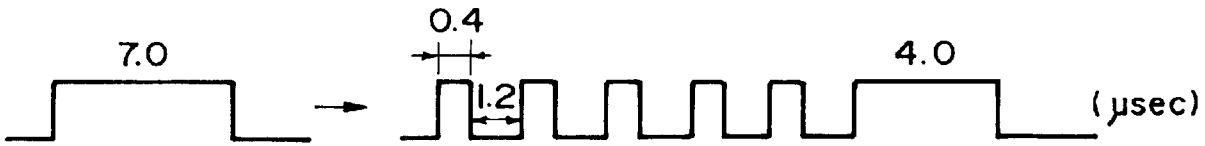

In an example of FIG. 11C wherein a conventional single pulse application required a pulse width of 7.0 μsec (left side), a droplet of the same volume could be discharged by a pulse train of the same voltage amplitude having a shorter total pulse width of 6.0 μsec (=0.4 μsec×4+4.0 μsec) (the right side).

In the above, there has been described an embodiment wherein pre-heating and bubble-generation pulses are applied through the preheater 2, but it is also possible to apply such pre-heating and bubble-generation pulses by a laser beam capable of heating the recording material nozzle by nozzle. However, it is not appropriate to apply such pre-heating and/or bubble-generation pulses by an external or indirect heating means because of poor heat-conducting efficiency, while such external heating may be adequately used for keeping a normally solid recording material in a molten state.

Hereinbelow, the present invention will be described based on more specific examples.

EXAMPLE 1

Image formation (recording) was performed by using a recording apparatus shown in FIG. 1 equipped with a recording head identical to the one shown in FIGS. 2A and 2B.

Referring to FIGS. 2A and 2B, the recording head had 48 nozzles 15 disposed at a density of 400 nozzles/inch. Each nozzle 15 had a height H of 22 μm and a width W of 30 μm and was provided with a heater 2 having a width of 22 μm and a length of 18 μm leaving an OH range of 30 μm to the ejection outlet.

A recording material was prepared by uniformly mixing the following components in solution and filtering the mixture through a polyethylene fluoride fiber filter having a pore diameter of 0.45 μm. The recording material showed a viscosity of 2.0 cps at 20° C.

| | |
|---|---|
| C.I. Food Black | 3.0 wt. % |
| Diethylene glycol | 15.0 wt. % |
| N-methyl-2-pyrollidone | 5.0 wt. % |
| Deionized water | 77.0 wt. % |

Figure 12:
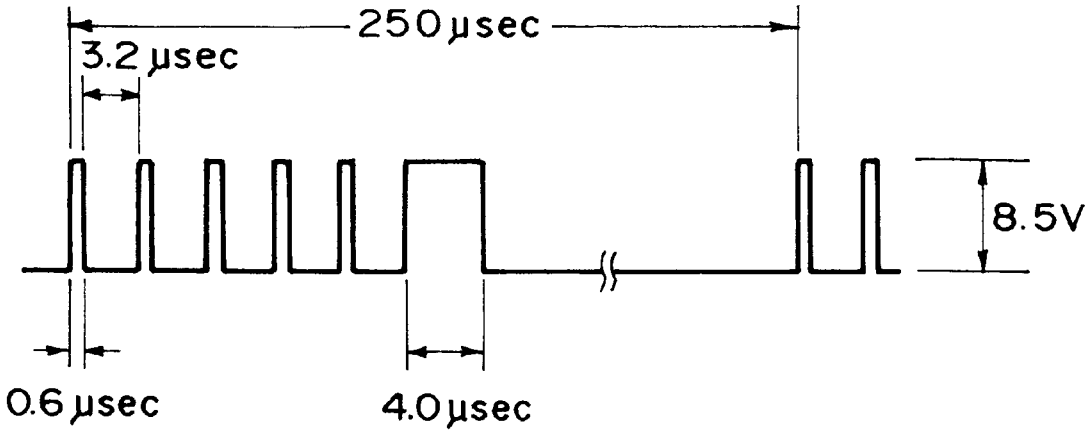
FIG. 12 illustrates a combination of pre-heating pulses and a bubble-generation pulse used in Example 1 appearing hereinafter.

A pulse train including pre-heating pulses and a bubble-generation pulse shown in FIG. 12 was applied to the heater 2. The pre-heating pulses included 5 pulses each having a width of 0.6 μsec and applied with a spacing of 3.2 μsec. The bubble-generation pulse was a single pulse having a width of 4.0 μsec and applied 3.2 μsec after the final pre-heating pulse. The pre-heating pulses and bubble-generation pulse all had a voltage of 8.5 volts. A pulse train including the above-mentioned pre-heating pulses and bubble-generation pulse was repeatedly applied in a cycle of 250 μsec (drive frequency of 4 kHz).

Under the above conditions, image signals giving a checker pattern having white and black elements alternating at respective pixels were supplied to the 48 heaters 2 to eject the ink onto plain paper (commercially available copying paper). As a result, a desired checker pattern free from density irregularity was formed on the plain paper. As a result of observation of the image in an enlarged form, it was found to be a clear image free from scattering or ground staining with the recording material.

Further, the bubble formation in and ejection of the recording material were observed from above the ceiling plate 4 made of transparent glass by using a pulse light source and a microscope. As a result, it was observed that each bubble communicated with the ambience 3 μsec. after the start of its creation, and the recording material was ejected at a speed of 18 m/sec.

EXAMPLE 2

Figure 13:
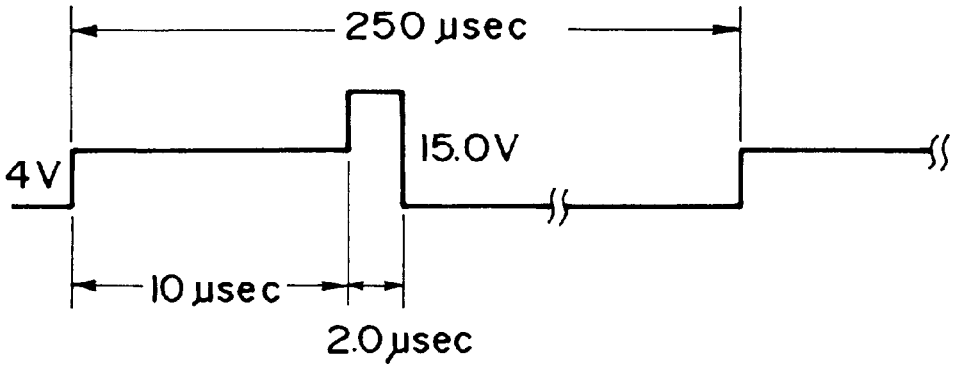
FIGS. 13–16 respectively illustrate a combination of (a) pre-heating pulse(s) and a bubble-generation pulse used in Examples 2–4 and 9, respectively, appearing hereinafter.

Recording was performed by using the recording apparatus and recording material used in Example 1 but applying a pulse train including a pre-heating pulse and a bubble-generation pulse shown in FIG. 13.

As shown in FIG. 13, the pre-heating pulse was a single pulse having a width of 10 μsec and a voltage of 4.0 volts, and the bubble-generation pulse was a single pulse having a width of 2.0 μsec and a voltage of 15.0 volts and applied with no spacing after the pre-heating pulse. The pulse train including the pre-heating and bubble-generation pulses was applied at a repetition cycle of 250 μsec (drive frequency: 4 kHz).

Under the above conditions, a clear checker pattern similarly as in Example 1 was obtained.

As a result of microscope observation similarly as in Example 1, it was found that each bubble communicated with the ambience 3 μsec after its creation and was ejected at a speed of 13 m/sec.

Comparative Example 1

Recording was performed in the same manner as in Example 1 except that only the bubble-generation pulse in the pulse train shown in FIG. 12 was applied to the heater 2. As a result, the recording material failed to be discharged soon.

EXAMPLE 3

A normally solid recording material was prepared by uniformly melt-mixing the following components under heating and filtering the mixture under heating through a polyethylene fluoride fiber filter having a pore diameter of 0.45 μm.

| | |
|---|---|
| C.I. Solvent Black 3 | 5.0 wt. % |
| Acetamide (m.p. = 82° C.) | 75.0 wt. % |
| Paraffin wax (m.p. = 69° C.) | 20.0 wt. % |

("NHP-11" available from Nihon Seiro K.K.)

Recording was performed by incorporating the normally solid recording material in an apparatus shown in FIG. 10 while keeping the recording material in a molten state under heating at 95° C. by heating means 22 and 24.

The recording head had 44 nozzles 15 disposed at a density of 400 nozzles/inch. Each nozzle 15 had a height H of 23 μm and a width W of 35 μm and was provided with a heater 2 having a width of 28 μm and a length of 30 μm leaving an OH range of 30 μm.

Figure 14:
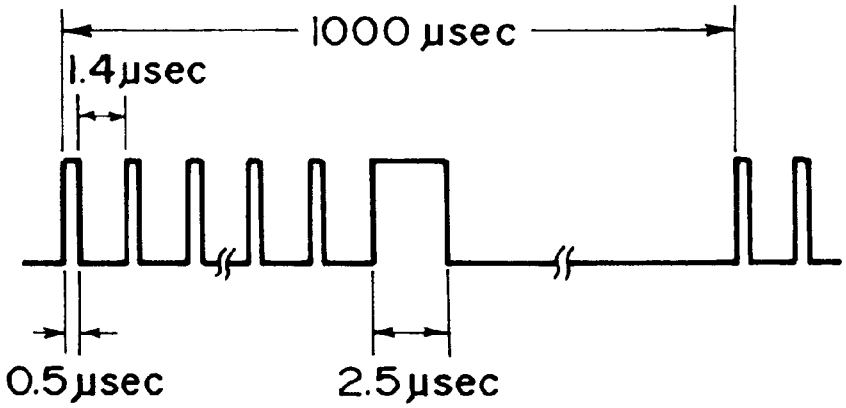

A pulse train including pre-heating pulses and a bubble-generation pulse shown in FIG. 14 was applied to the heater 2. The pre-heating pulses included 40 pulses each having a width of 0.5 μsec and applied with a spacing of 1.4 μsec. The bubble-generation pulse was a single pulse having a width of 2.5 μsec and applied 1.4 μsec after the final pre-heating pulse. The pre-heating pulses and bubble-generation pulse all had a voltage of 15.0 volts. The pulse train including the above-mentioned pre-heating pulses and bubble-generation pulse was repeatedly applied in a cycle of 1000 μsec (drive frequency of 1 kHz).

Under the above conditions, image signals giving a checker pattern having white and black elements alternating at respective pixels were supplied to 16 heaters 2 to eject the ink onto plain paper (commercially available copying paper). As a result, a desired checker pattern free from density irregularity was formed on the plain paper. The resultant image was quickly fixed and was not disordered by hard rubbing at 5 seconds after the recording. As a result of observation of the image in an enlarged form, it was found to be a clear image free from scattering or ground staining with the recording material.

Further, the bubble formation in and ejection of the recording material were observed from above the ceiling plate 4 made of transparent glass by using a pulse light source and a microscope. As a result, it was observed that each bubble communicated with the ambience 3 μsec. after the start of its creation, and the recording material was ejected at a speed of 12 m/sec.

EXAMPLE 4

A normally solid recording material was prepared by uniformly melt-mixing the following components under heating and filtering the mixture under heating through a polyethylene fluoride fiber filter having a pore diameter of 0.45 μm.

| | |
|---|---|
| C.I. Solvent Black 3 | 3.0 wt. % |
| ε-Caprolactam (m.p. = 69° C.) | 83.0 wt. % |
| Microcrystalline wax (m.p. = 84° C.) | 14.0 wt. % |

("Hi-Mic 1080" available from Nihon Seiro K.K.)

Recording was performed by incorporating the normally solid recording material in the same apparatus used in Example 3 while keeping the recording material in a molten state under heating at 100° C. by heating means 22 and 24.

Figure 15:
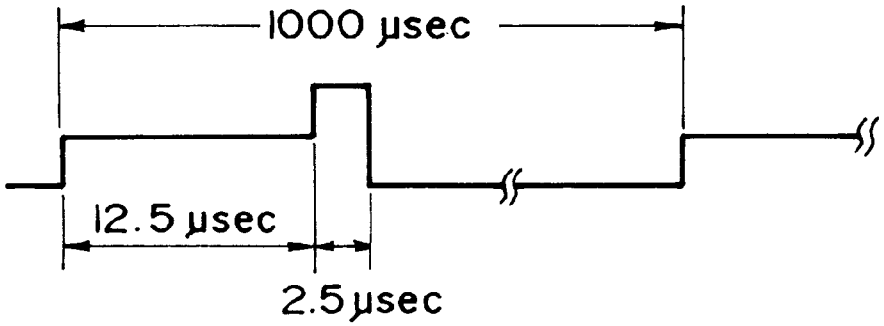

A pulse train including a pre-heating pulse and a bubble-generation pulse shown in FIG. 15 was applied to the heater 2. The pre-heating pulse was a single pulse having a width of 12.5 μsec and a voltage of 8.0 volts. The bubble-generation pulse was a single pulse having a width of 2.5 μsec and a voltage of 8.0 volts and applied with no spacing after the pre-heating pulse. The pulse train including the above-mentioned pre-heating pulse and bubble-generation pulse was repeatedly applied in a cycle of 1000 μsec (drive frequency of 1 kHz).

Under the above conditions, the same pattern as in Example 3 was formed. As a result, a similarly clear image was formed on the recording paper. The resultant image was quickly fixed and was not disordered by hard rubbing at 5 seconds after the recording.

Further, the bubble formation in and ejection of the recording material were observed similarly as in Example 1. As a result, it was observed that each bubble communicated with the ambience 3 μsec. after the start of its creation, and the recording material was ejected at a speed of 11 m/sec.

EXAMPLES 5–8

Four normally solid recording materials respectively having compositions shown below were prepared similarly as in Example 3.

| | |
|---|---|
| [Example 5] | |
| Palmitic acid (m.p. = 62° C.) | 55 wt. % |
| γ-Butyrolacetone (V.P. (=vapor pressure) = 0.5 mmHg at 25° C.) | 40 wt. % |
| C.I. Solvent Black 5 | 5 wt. % |
| [Example 6] | |
| 1,12-Dodecanediol (m.p. = 82° C.) | 48 wt. % |
| 2 - Pyrrolidone (V.P. = 0.03 mmHg at 25° C.) | 50 wt. % |
| C.I. Solvent Red 49 | 2 wt. % |

-continued

| | |
|---|---|
| [Example 7] | |
| Stearic acid (m.p. = 67° C.) | 32 wt. % |
| Lauric acid (m.p. = 45° C.) | 10 wt. % |
| Diethylene glycol monoethyl ether acetate (V.P. = 0.1 mmHg at 25° C.) | 53 wt. % |
| C.I. Solvent Yellow 56 | 5 wt. % |
| [Example 8] | |
| Stearyl alcohol (m.p. = 59° C.) | 28 wt. % |
| 1-Tetradecanol (m.p. = 40° C.) | 15 wt. % |
| Diacetone alcohol (V.P. = 2.0 mmHg at 25° C.) | 50 wt. % |
| C.I. Solvent Blue 35 | 7 wt. % |

Each normally solid recording material was used for recording by using the same apparatus under the same driving conditions as in Example 3 on three types of commercially available copying papers (Canon NP-DRY, Xerox 4024 and Ricoh PPC Paper 6000), and the resultant image was evaluated by observation through a microscope with respect to blurring of the image.

As a result, no blurring of the image was observed in any case.

Comparative Example 2

Recording was performed in the same manner as in Example 3 except that only the bubble-generation pulse in the pulse train shown in FIG. 14 was applied to the heater 2. As a result, some fluctuation was observed in location of the recording material attached onto the recording paper. As a result of observation of bubble formation and ejection state, the recording material was ejected at a low speed of 1 m/sec.

EXAMPLE 9

Two types of recording heads each having a structure as shown in FIGS. 2A and 2B but having different OH ranges of 20 μm and 25 μm, respectively, were prepared. With respect to the other points, both heads had the same dimensions including 44 nozzles at a density of 400 nozzles/inch, each nozzle having a height of 27 μm and a width of 40 μm and including a heater measuring 40 μm in length and 32 μm in width.

Figure 16:
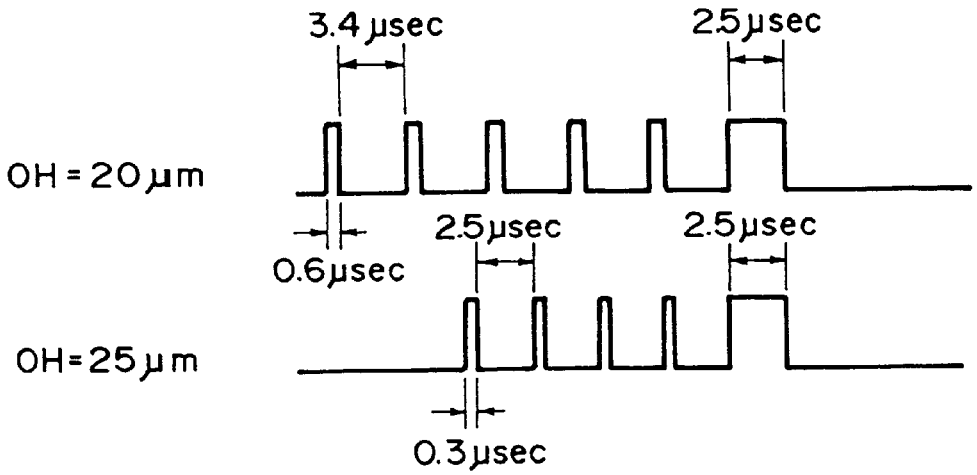
Figure 17:
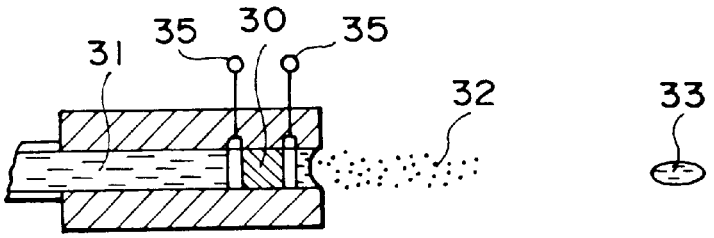
F I G. 17 PRIOR ART
FIG. 17 is a sectional view for illustrating a known recording method.
Figure 18A:
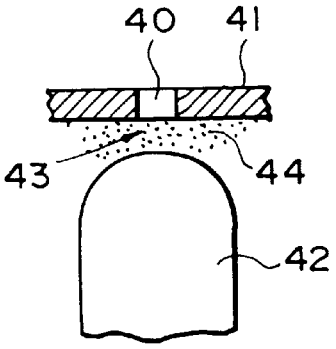
FIG. 18A PRIOR ART
FIGS. 18A–18C are sectional views for illustrating another known recording method.
Figure 18B:
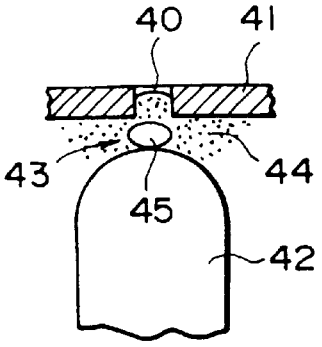
FIG. 18B PRIOR ART
Figure 18C:
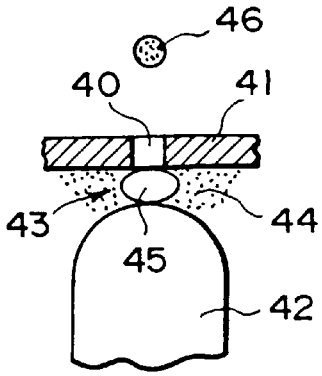
FIG. 18C PRIOR ART
Figure 19A:
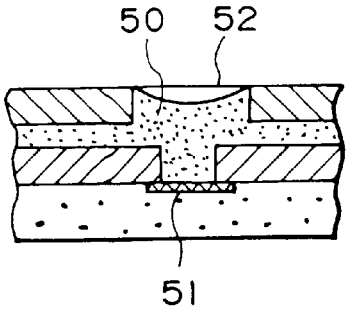
FIG. 19A PRIOR ART
FIGS. 19A and 19B are sectional views for illustrating another known recording method.
Figure 19B:
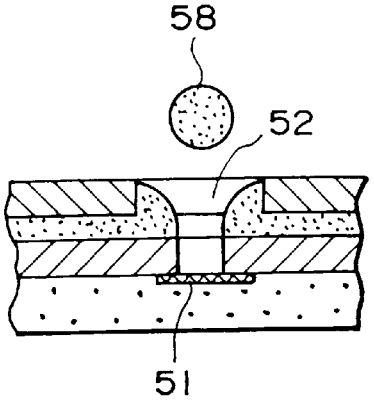
FIG. 19B PRIOR ART
Figure 20:
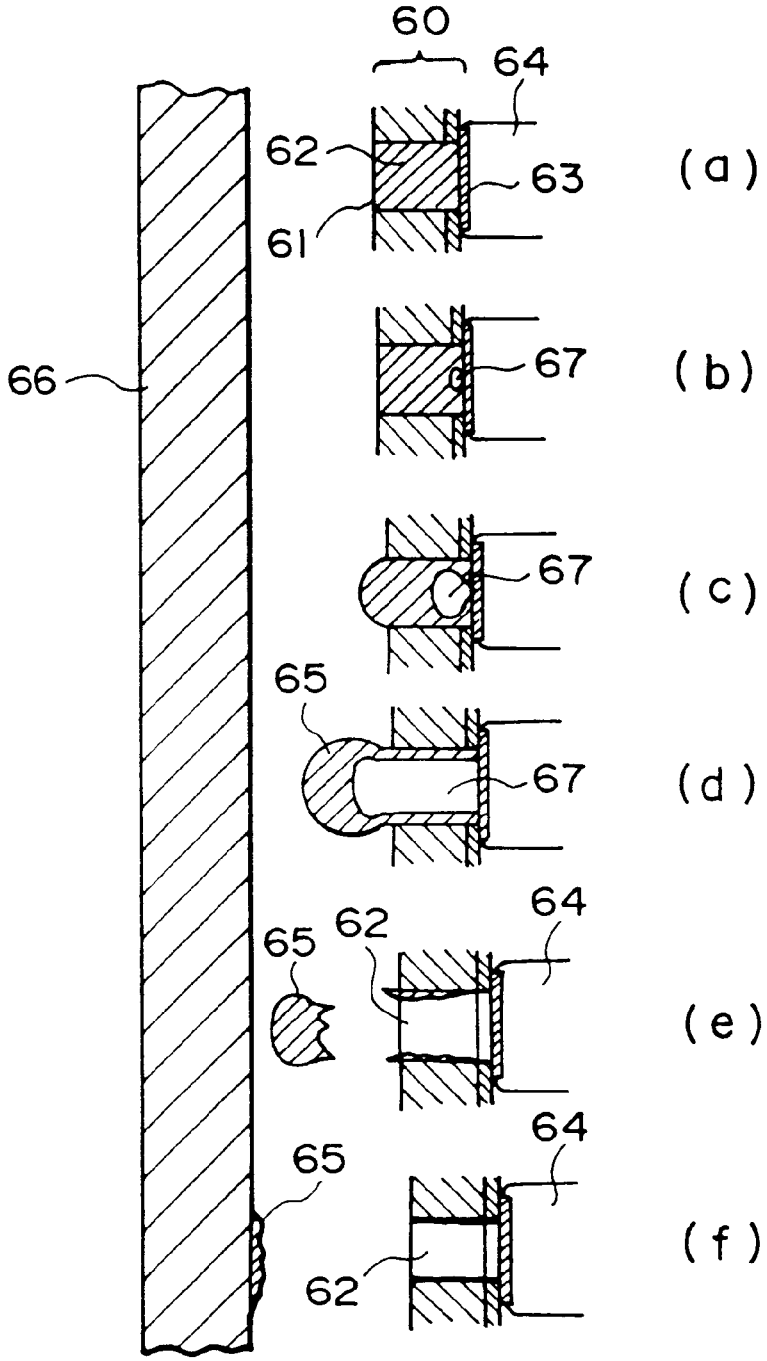
FIG. 20 PRIOR ART
FIG. 20 shows a set of sectional views for illustrating still another known recording method.

Pulse trains as shown in FIG. 16 were applied to the heaters 2 of the respective heads.

More specifically, for the head having an OH range of 20 μm. the heaters 2 were supplied with a pulse train including five 0.6 μm-wide pre-heating pulses with a spacing of 3.4 μsec each and a 2.5 μsec-wide single bubble-generation pulse applied 3.4 μsec after the final pre-heating pulse. The pre-heating pulses and bubble-generation pulse all had a voltage of 8.7 volts, and the pulse train was applied in a repetition cycle of 500 μsec (drive frequency=2 kHz).

On the other hand, for the head having an OH range of 25 μm, the heaters 2 were supplied with a pulse train including four 0.3 μm-wide pre-heating pulses with a spacing of 2.5 μsec each and a 2.5 μsec-wide single bubble-generation pulse applied 2.5 μsec after the final pre-heating pulse. The pre-heating pulses and bubble-generation pulse all had a voltage of 8.7 volts, and the pulse train was applied in a repetition cycle of 500 μsec (drive frequency=2 kHz).

By using each of the above two types of recording heads, image signals giving a checker pattern with white and black elements alternating at respective pixels were supplied to form an image on plain paper (a commercially available copying paper). No difference in image quality was observed depending on the recording head used, but clear images free from density irregularity were obtained in both cases.

In both cases of using the above two-types of recording heads, the volume of a recording material droplet from a nozzle was measured, whereby the same value of 30 pl was obtained in both cases.

What is claimed is:

1. A jet recording method, comprising the steps of:

providing a nozzle comprising an inner side wall defining a longitudinal path and terminating with a side wall end, a heater disposed on the inner side wall, and an election outlet disposed at the side wall end opposite the heater;

supplying a recording material to the longitudinal path; and generating a bubble by sequentially actuating the heater to pre-heat the recording material supplied in said supplying step and heat the pre-heated recording material to generate the bubble within the recording material, thus ejecting a droplet of the recording material, wherein the preheating of the recording material is performed by actuating the heater by a voltage pulse having a width of 0.2–1.0 μsec to stabilize a bubble-through jet recording mode in which the bubble generated in said bubble generating step is caused to communicate with ambience, thereby ejecting the droplet of the recording material in a substantially constant volume and along a substantially constant ejection path.

2. A method according to claim 1, wherein the bubble communicates with the ambience when the bubble has an internal pressure not higher than an ambient pressure.

3. A method according to claim 1, wherein the recording material is pre-heated by actuating the heater with a single voltage pulse.

4. A method according to claim 1, wherein the recording material is pre-heated by actuating the heater with a plurality of voltage pulses.

5. A method according to claim 1, wherein said recording material is pre-heated by applying a single pre-heating pulse and then heated for generating the bubble by applying a bubble-generation, pulse having a higher voltage than the pre-heating pulse.

6. A method according to claim 1, wherein said recording material is liquid at room temperature in a range of 5–35° C. and is pre-heated by applying 2–30 pre-heating pulses.

7. A method according to claim 6, wherein said recording material is pre-heated by applying 3–20 pre-heating pulses.

8. A method according to claim 6, wherein said recording material is pre-heated by applying 3–5 pre-heating pulses.

9. A method according to claim 1, wherein said recording material is solid at room temperature in a range of 5–35° C. and is pre-heated by applying 10–60 pre-heating pulses.

10. A method according to claim 9, wherein said recording material is pre-heated by applying 20–50 pre-heating pulses.

11. A method according to claim 9, wherein said recording material is solid at room temperature in a range of 5–35° C. and comprises a heat-fusible solid substance and a colorant.

12. A method according to claim 9, wherein said recording material is solid as a whole at room temperature in a range of 5–35° C. and said recording material comprises a heat-fusible solid substance, a colorant, and a substance having a vapor pressure of at most 3.0 mmHg at 25° C.

13. A method according to claim 1, wherein said recording material is pre-heated to a temperature which varies depending on an amount of the recording material contained in a range of the path between the heater and the ejection outlet.

14. A jet recording method, comprising the steps of:

providing a plurality of nozzles, each of the plurality of nozzles comprising an inner side wall defining a longitudinal path and terminating with a side wall end, a heater disposed on the inner side wall, and an ejection outlet disposed at the side wall end opposite the heater;

supplying a recording material to the plurality of longitudinal paths; and generating bubbles by sequentially actuating the heaters to pre-heat the recording material supplied in said supplying step to the nozzles and heat the pre-heated recording material to generate the bubbles within the recording material, thus ejecting droplets of the recording material, wherein the preheating of the recording material is performed by actuating the heaters by a voltage pulse having a width of 0.2–1.0 $\mu$sec to stabilize a bubble-through jet recording mode in which the bubbles generated in said bubble generating step are caused to communicate with ambience, thereby ejecting the droplets of the recording material in substantially constant volumes and along substantially constant ejection paths.

15. A method according to claim 14, wherein each of the sequences of actuating the heaters in said bubble generating step is controlled such that the volumes of the droplets ejected out of all of the nozzles are equal.

16. A method according to claim 14, wherein the bubbles communicate with the ambience when the bubbles have an internal pressure not higher than an ambient pressure.

17. A method according to claim 14, wherein the recording material is pre-heated by actuating each of the heaters with a single voltage pulse.

18. A method according to claim 14, wherein the recording material is pre-heated by actuating each of the heaters with a plurality of voltage pulses.

19. A method according to claim 14, wherein in each of the nozzles said recording material is pre-heated by applying a single pre-heating pulse and then heated for generating the bubble by applying a bubble-generation pulse having a higher voltage than the pre-heating pulse.

20. A method according to claim 14, wherein said recording material is liquid at room temperature in a range of 5–35° C. and is pre-heated in each of the nozzles by applying 2–30 pre-heating pulses.

21. A method according to claim 20, wherein said recording material is pre-heated in each of the nozzles by applying 3–20 pre-heating pulses.

22. A method according to claim 20, wherein said recording material is pre-heated in each of the nozzles by applying 3–5 pre-heating pulses.

23. A method according to claim 14, wherein said recording material is solid at room temperature in a range of 5–35° C. and is pre-heated in each of the nozzles by applying 10–60 pre-heating pulses.

24. A method according to claim 23, wherein said recording material is pre-heated in each of the nozzles by applying 20–50 pre-heating pulses.

25. A method according to claim 23, wherein said recording material is solid at room temperature in a range of 5–35° C. and comprises a heat-fusible solid substance and a colorant.

26. A method according to claim 23, wherein said recording material is solid as a whole at room temperature in a range of 5–35° C. and said recording material comprises a heat-fusible solid substance, a colorant, and a substance having a vapor pressure of at most 3.0 mmHg at 25° C.

27. A method according to claim 14, wherein said recording material is pre-heated to a temperature which varies depending on an amount of the recording material contained in each of the nozzles in a range of the path between the heater and the ejection outlet.

* * * * *

UNITED STATES PATENT AND TRADEMARK OFFICE

CERTIFICATE OF CORRECTION

PATENT NO. : 6,076,919
DATED : June 20, 2000
INVENTOR(S) : Shirota et al.

It is certified that error appears in the above-identified patent and that said Letters Patent is hereby corrected as shown below:

Column 1:
Line 34, "19A-19C," should read -- 18A-18C, --.
Line 58, "thermal," should read -- thermal --.

Column 7:
Line 9, "(unshown)" should read -- 24 (shown in Fig. 10) --.
Line 17, " "pre-heating" " should read -- "pre-heating") --.

Column 13:
Line 33, the underlining should be deleted.
Line 35, "(" NHP-11" available from Nihon Seiro K.K.)" should read
-- ("NHP-11" available from Nihon Seiro K.K.) --.

Column 14:
Line 21, the underlining should be deleted.
Line 22, "("Hi-Mic 1080" available from Nihon Seiro K.K." should read
-- ("Hi-Mic 1080" available from Nihon Seiro K.K. --.

Column 16:
Line 45, "bubble-generation," should read -- bubble-generation --.

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*